US006401630B1

(12) United States Patent
Peterson

(10) Patent No.: US 6,401,630 B1
(45) Date of Patent: Jun. 11, 2002

(54) CONVERTIBLE ARTICLE OF FURNITURE

(76) Inventor: William F. Peterson, 148 W. 16 St., #4, New York, NY (US) 10011

( * ) Notice: Subject to any disclaimer, the term of this patent is extended or adjusted under 35 U.S.C. 154(b) by 0 days.

(21) Appl. No.: 09/526,697

(22) Filed: Mar. 15, 2000

Related U.S. Application Data

(63) Continuation-in-part of application No. 09/502,918, filed on Feb. 9, 2000, now abandoned.

(51) Int. Cl.[7] ..... A47B 5/00
(52) U.S. Cl. ..... 108/12; 108/115; 108/34
(58) Field of Search ..... 108/12, 145, 144.11, 108/120, 116, 117, 118, 115, 34; 248/161, 407, 157, 423, 164, 432, 688.2; 5/11, 115

(56) References Cited

U.S. PATENT DOCUMENTS

| | | | | |
|---|---|---|---|---|
| 981,114 A | | 1/1911 | Ridgely | |
| 2,643,923 A | | 6/1953 | Beall | |
| 2,666,681 A | | 1/1954 | Adler | |
| 2,958,873 A | | 11/1960 | Ferneau | |
| 3,081,055 A | * | 3/1963 | Fuller | 108/34 X |
| 3,387,572 A | * | 6/1968 | Ulrich | 108/34 |
| 3,688,705 A | | 9/1972 | Baraabas | |
| 4,296,694 A | | 10/1981 | Kobayashi | 108/116 |
| 5,280,753 A | | 1/1994 | Kavanagh et al. | |
| 5,329,710 A | | 7/1994 | Huddleston | |
| 5,535,683 A | | 7/1996 | Novak | |
| 5,588,377 A | | 12/1996 | Fahmian | |
| 5,645,259 A | * | 7/1997 | Chen | 108/118 X |
| 5,992,333 A | * | 11/1999 | Lai | 108/115 X |
| 6,079,338 A | * | 6/2000 | Yeh | 108/115 |
| 6,199,489 B1 | * | 3/2001 | Tsai | 108/115 X |

FOREIGN PATENT DOCUMENTS

| | | |
|---|---|---|
| GB | 439898 | 12/1935 |

* cited by examiner

*Primary Examiner*—Jose V. Chen
(74) *Attorney, Agent, or Firm*—Fish & Neave; Joel Weiss; Andrew Van Court

(57) ABSTRACT

A convertible article of furniture that is converted between a first position, in which the article preferably provides a relatively low, flexible, flat surface, where the article can act as a bed, and a second position, in which the article acts preferably provides a relatively high, rigid, flat surface is provided, where the article can act as a table. The transition between bed and table, and back again, is provided by changing the position of engagement of the support of the surface structure as provided by a base member with respect to the surface member. In the first position, the base member provides support distant from a central longitudinal axis of the surface, substantially about the sides of the surface, thereby allowing the surface member to be flexible along and about its central longitudinal axis and the surface is supported in a lower position. In the second position, the base member provides support to the surface member proximal to the central longitudinal axis and the surface is supported in a higher position.

32 Claims, 10 Drawing Sheets

CONVERTIBLE ARTICLE OF FURNITURE

CROSS-REFERENCE TO RELATED APPLICATIONS

This application is a continuation-in-part of U.S. patent application Ser. No. 09/502,918 filed on Feb. 9, 2000 now abandoned.

BACKGROUND OF INVENTION

This invention relates to articles of furniture that occupy relatively small amounts of space with respect to their functionality. More specifically, this invention relates to furniture that may be converted from one use to another.

In certain communities where personal living space is limited, furniture must be designed to occupy a minimum of space, yet retain a high level of functionality. For example, in urban communities, living space is limited, and the furniture must be designed accordingly. Large and unwieldy pieces of furniture are not optimal in such communities. Convertible pieces of furniture, e.g., sofabeds, provide increased functionality while occupying relatively little space and are, therefore, optimal for communities where living space is limited.

In other communities, e.g., mobile military communities, relatively small, light, multi-functional furniture is highly desirable. Such furniture can substantially help increase the mobility of the community.

For these and other reasons, it would be desirable to provide a piece of furniture that consumes a minimum of space.

It would also be desirable to provide a piece of furniture that can easily be converted from serving one function to serving another.

It would also be desirable to provide a piece of furniture that is convertible from one use to another and is relatively mobile.

SUMMARY OF THE INVENTION

It is an object of this invention to provide a piece of furniture that consumes a minimum of space.

It is a further object of this invention to provide a piece of furniture that can easily be converted from serving one function to serving another.

It is a still further object of this invention to provide a piece of furniture that is convertible from one use to another and is relatively mobile.

A convertible piece of furniture is provided. The furniture preferably includes first and second elongated members at a first distance from one another, a surface member connected between the elongated members that provides a flexible surface therebetween, first and second locking members, each locking member having ends and a midpoint, wherein each locking member is connected to the first elongated member proximal to one end and connected to the second elongated member proximal to the other end, a base member having a first end portion, a second end portion and a center portion, the base member being connected to the locking members, the base member being movable between a first position and a second position. In the first position, the first end portion is connected proximal to the ends of the first locking member and the second end portion is connected proximal to the ends of the second locking member, distant from the axis, such that surface, proximal to the axis, is unsupported by the center portion of the base member. In the second position, the first end portion is connected proximal to the midpoint of the first locking member and the second end portion is connected proximal to the midpoint of the second locking member such that the surface is supported proximal to the axis by the center portion.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
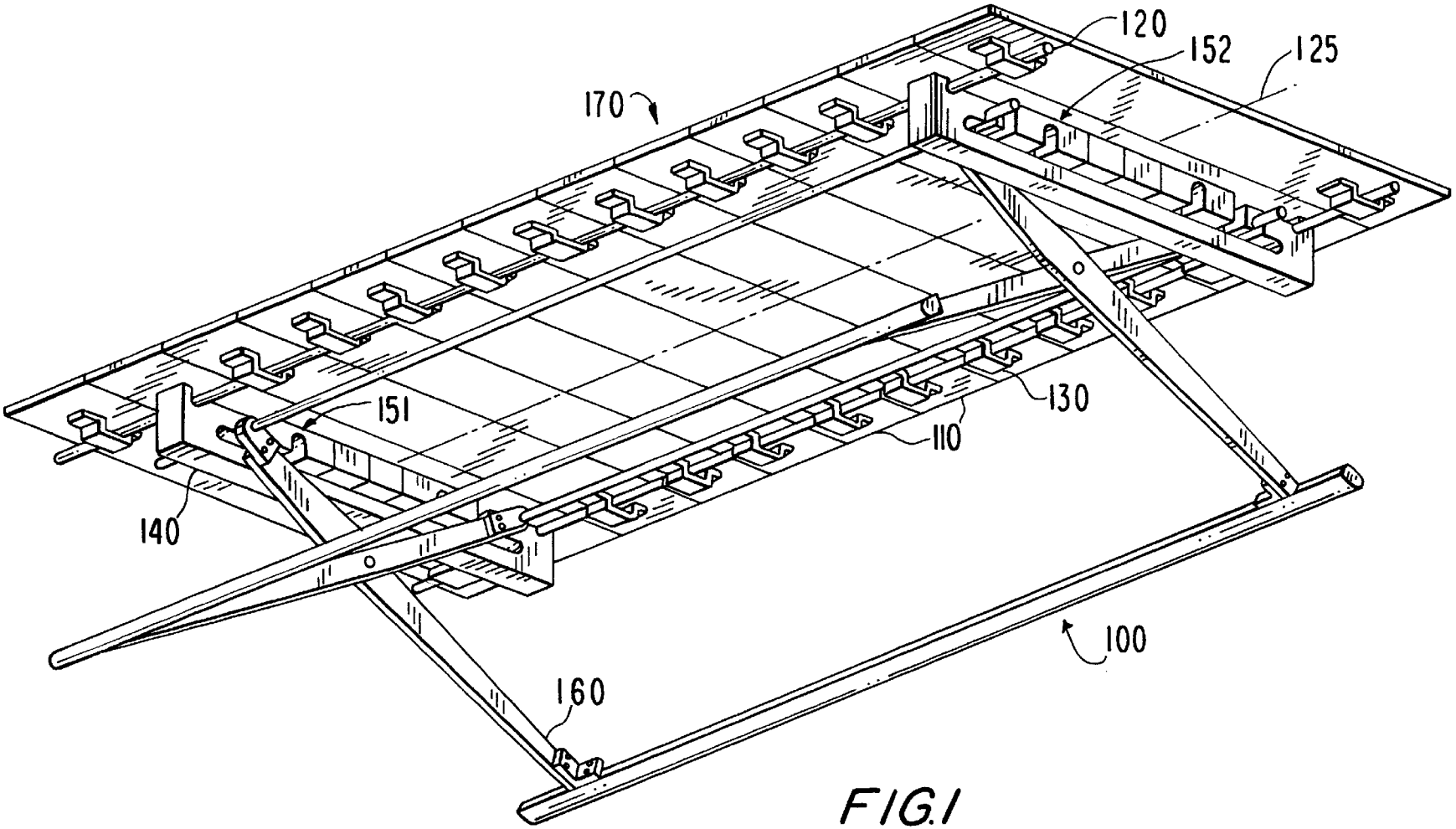
FIG. 1 is a bottom elevational view of a convertible piece of furniture according to the invention.

A piece of furniture convertible between a first position, in which the furniture preferably provides a low, flexible surface that may be used as a bed, and a position in which the furniture preferably provides a high, rigid, surface that may be used as a table, is provided.

The furniture preferably includes a flexible surface member which provides a surface for a user. The surface member may be formed from a single flexible piece of material—e.g., thin wood, plastic or suitable cloth—as is known in the art.

The surface member provides a flat surface and is disposed between, and connected to, two elongated members—e.g., poles. In a preferred embodiment, the surface member is formed from flexible slats which are arranged adjacent and parallel to one another and perpendicular to the poles. Each pole is preferably connected all the slats proximal to the ends of the slats; the first pole is connected proximal to one end of each slat and the second pole is connected proximal to the other end of each slat. The connection between pole and slat can be fixed or moveable. As with the single surface member, a flat surface is formed by the plurality of slats preferably on the portion of the slats which is located between the poles.

Also connected between the poles are two locking members. These locking members also are preferably disposed between and perpendicular to the poles. Unlike the slats in the preferred embodiment, the locking members are attached to the elongated members at some pre-determined distance from one another, thereby leaving a portion of the surface member unsupported proximal to a central longitudinal axis of the surface member.

Each of the two locking members may be formed from two discrete pieces. Each of the pieces preferably has sockets or some other suitable means of fixedly connecting to the base member. Each socket on one locking member preferably corresponds to each socket on the other locking member to form a socket pair. The socket pairs or other suitable apparatus for connecting to the base should preferably allow the base to be attached to the locking members in at least two different positions. The function of each piece of the locking member will be explained in greater detail below.

At least one piece of the locking member preferably has sockets that are for use when the base member is in either a storage position or a bed position. The first piece also provides slots in which to move the base member from position to position without detaching the base member from the surface.

The second piece of the locking member may also preferably have sockets. These sockets are for connecting to the base member when the base member is in a table position. The second piece of the locking member is preferably formed from one of the slats, and can either be flexible or rigid, depending on the position of the furniture.

In a first position, the base is preferably attached to the locking members such that a portion of the base provides support to the surface member proximal to its central longitudinal axis and the base raises the surface member off the ground to some pre-determined height. In this position, the surface member is supported on two sides by the elongated members and proximal to its central longitudinal axis by the base member. This causes the surface member to form a substantially rigid surface which can be used for a table or other similar use where a rigid raised surface is required.

In a second position, the base is preferably attached to the locking members such that the surface member is unsupported proximal to its central longitudinal axis and preferably supports the surface in a position that is relatively lower than the first position. In this position, the surface member provides a flexible surface about its central longitudinal axis because it is supported on its ends, but not along its central longitudinal axis. Such a surface is suitable for use as a bed or other furniture which requires a flexible surface.

FIG. 1 shows the underside of a preferable embodiment of a piece of furniture 100 according to the principles of the invention. In this embodiment, slats 110, which provide the surface of use, are connected substantially between to poles 120 by connectors 130 proximal to the endpoints of slats 110. Slats 110 can preferably be connected by any suitable means to poles 120. Slats 110 also have a central longitudinal axis 125.

Locking members 140 are also preferably connected between poles 120. Each of locking members 140 preferably has sockets 151, 152 or some other suitable means for engaging base member 160. Each of the sockets on one locking member preferably correspond to a socket on the other locking member to form a socket pair. For example, socket 151 and socket 152 join to form a socket pair.

Base member 160, preferably a scissor-type support structure, is configured to fit into the sockets of locking members 140. In FIG. 1, two positions are possible for base member 160. Base member 160 can be inserted in either the outside socket pairs or the inside socket pairs or in a storage position, as will be explained with reference to FIG. 4B.

When base member 160 is inserted in the outer socket pairs, distant from central longitudinal axis 125, surface 170 of slats 110 is unsupported between poles 120 (with the exception of the portion of the slats 110 which is substantially supported by locking members). Therefore, in this position, slats 110 will be flexible between the two poles. In addition, the distance of surface 170 from the ground will be reduced. Thus, in the position shown in FIG. 1, slats 110 provide a relatively low, flexible surface 170. Such a surface is well-suited for use as a bed.

Figure 2:
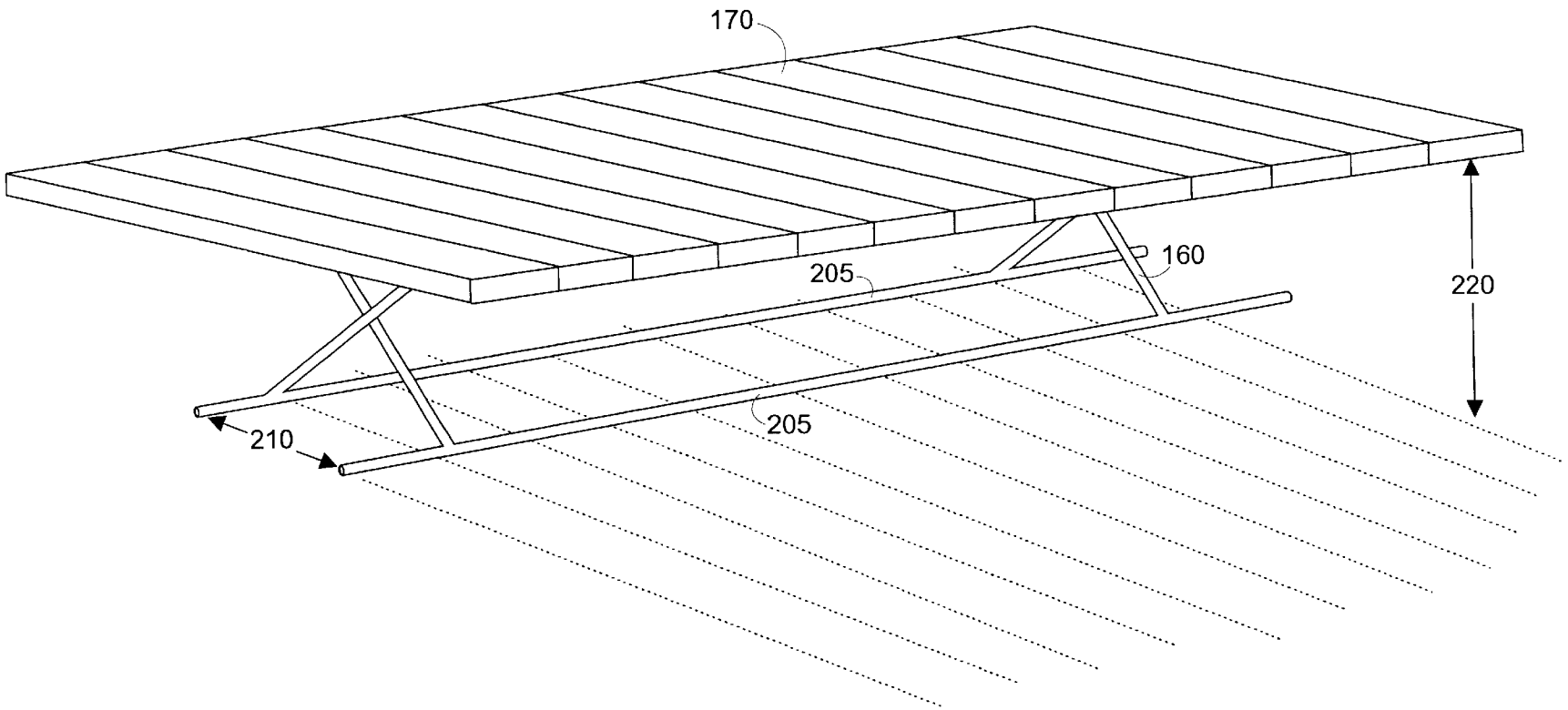
FIG. 2 is a top elevational view of a convertible piece of furniture disposed in a first position according to the invention.

FIG. 2 shows another view of furniture 100 having base member 160 in a "bed" position—i.e., inserted into the outer socket pairs. It can be seen from FIG. 2 that the bottom bars 205, which add stability to the invention but are not required, of base member 160 are spread relatively wide, to distance 210, and surface 170 is only raised a relatively small distance 220 away from the ground.

Figure 3:
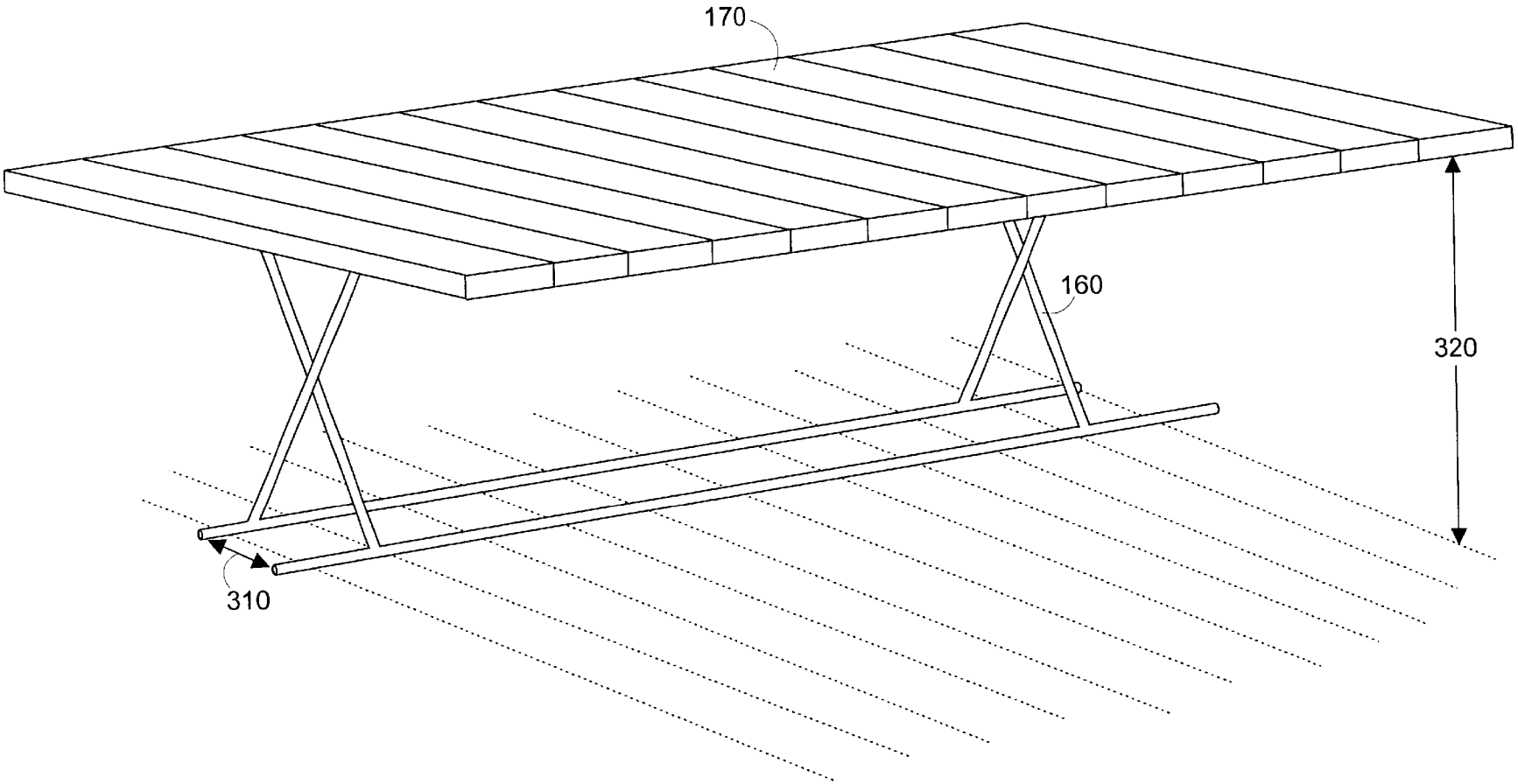
FIG. 3 is top elevational view of a convertible piece of furniture disposed in a second position according to the invention.

FIG. 3 shows another view of furniture 100 having base member 160 in a "table" position—i.e., inserted into the inner socket pairs. When base member 160 is inserted in the inner socket pairs — e.g., sockets 151 and 152 (shown in FIG. 1)—surface 170 of slats 110 is supported proximal to central longitudinal axis 125 by base member 160. Therefore, in this position, slats 110 are substantially rigid between the two poles. In addition, surface 170's height is increased. Therefore, in this position, slats 110 provide a relatively high, rigid surface 170. Such a surface is well-suited for use as a table.

It can be seen from FIG. 3 that the bottom portion of base member 160 is spread relatively narrowly, to distance 310, and surface 170 is a relatively large distance 320 away from the ground.

FIGS. 4A–D show front views of locking member 140. In these FIGURES, the locking member is shown as divided into two discrete pieces, a base mounting member 410 and a locking slat 420.

Figure 4A:
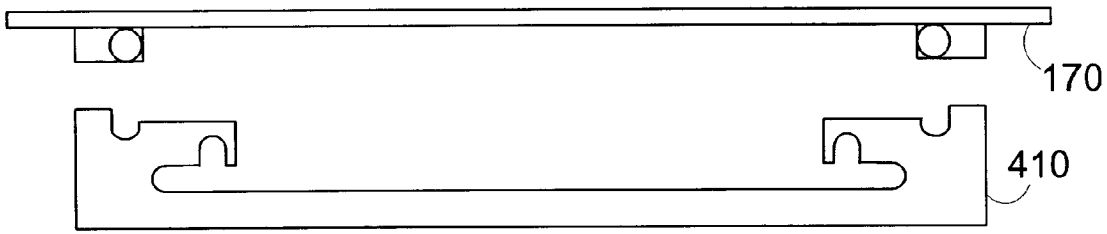
FIG. 4A is a front view of a locking member according to the invention.

FIG. 4A shows a side view of base mounting member 410 and surface 170. Base mounting member 410 provides sockets for base member 160 when base member is either in a storage position, as shown in FIG. 4B and as will be explained later, or in a bed position, as shown in FIG. 4C.

Figure 4B:
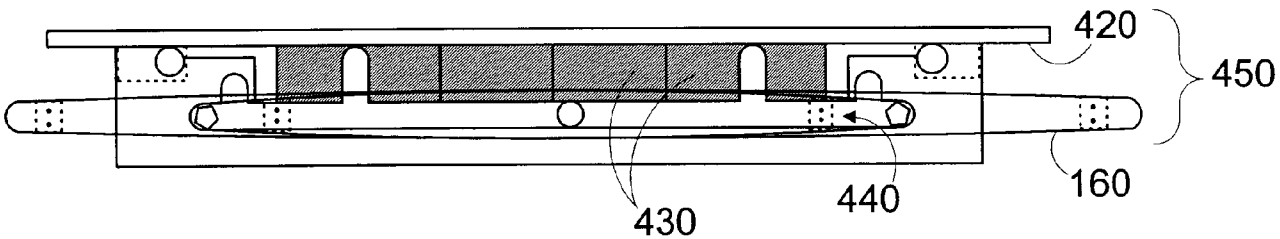
FIG. 4B is a front view of a locking member and locking slat in a first position according to the invention.
Figure 4D:
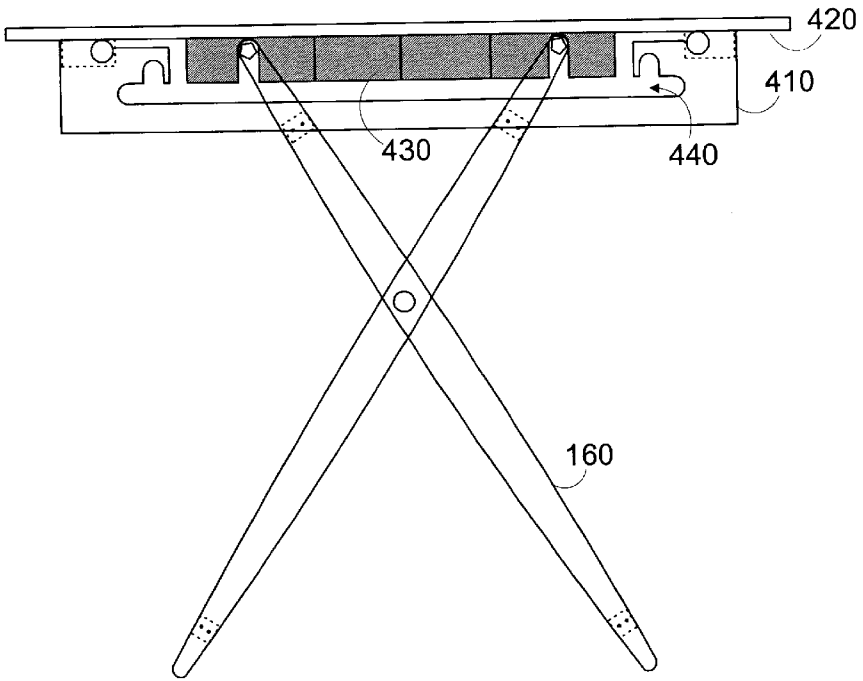
FIG. 4D is a front view of a locking member and locking slat in a third position according to the invention.
Figure 4C:
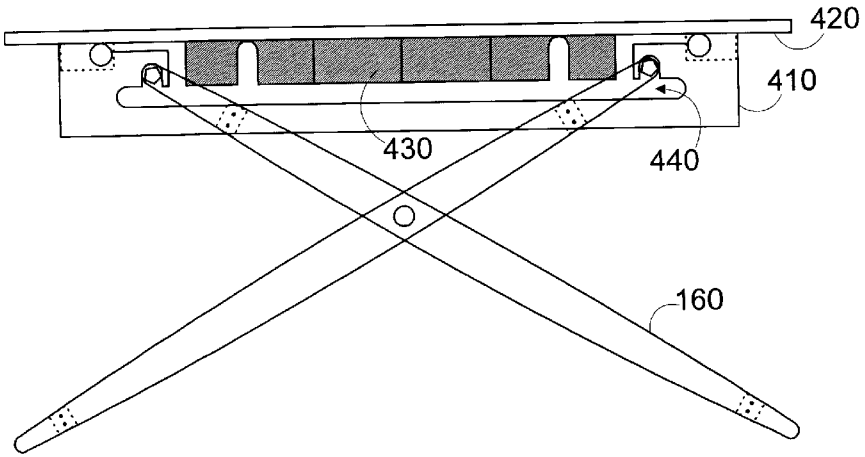
FIG. 4C is a front view of a locking member and locking slat in a second position according to the invention.

FIGS. 4B–D also show a side view of locking slat 420. Locking slat 420 preferably includes a number of blocks 430 attached to its bottom surface. When furniture 100 is in a bed position, as shown in FIG. 4C, blocks 430 allow locking slat 420 to be flexible. Thus, a substantial portion of surface 170 of furniture 100 is flexible when in a bed position.

When base member 160 is in a table position, as shown in FIG. 4D, blocks 430, as opposed to base mounting member 410, provide sockets for base member 160. Thus, in one position locking slat 420 is flexible and allows surface 170 to be flexible, and in another position it is rigid and promotes the rigidity of surface 170.

When base member 160 is moved between one socket pair and another, the upper portions of the base member preferably are maneuvered to pass through slot 440. Slot 440 also allows base member 160 to be removed completely from locking member 140 by pulling the portion of base member 160 that engages the slots into slot 440 and pivoting base member 160 with respect to locking member 140.

In FIG. 4B, additional socket pairs in base mounting member 410 are utilized to provide a position for the base member whereby the base member can be laid substantially flat against the underside of surface 170. This position allows easy storage because the effective height 450 of furniture 100 is reduced to a minimum.

Figure 5:
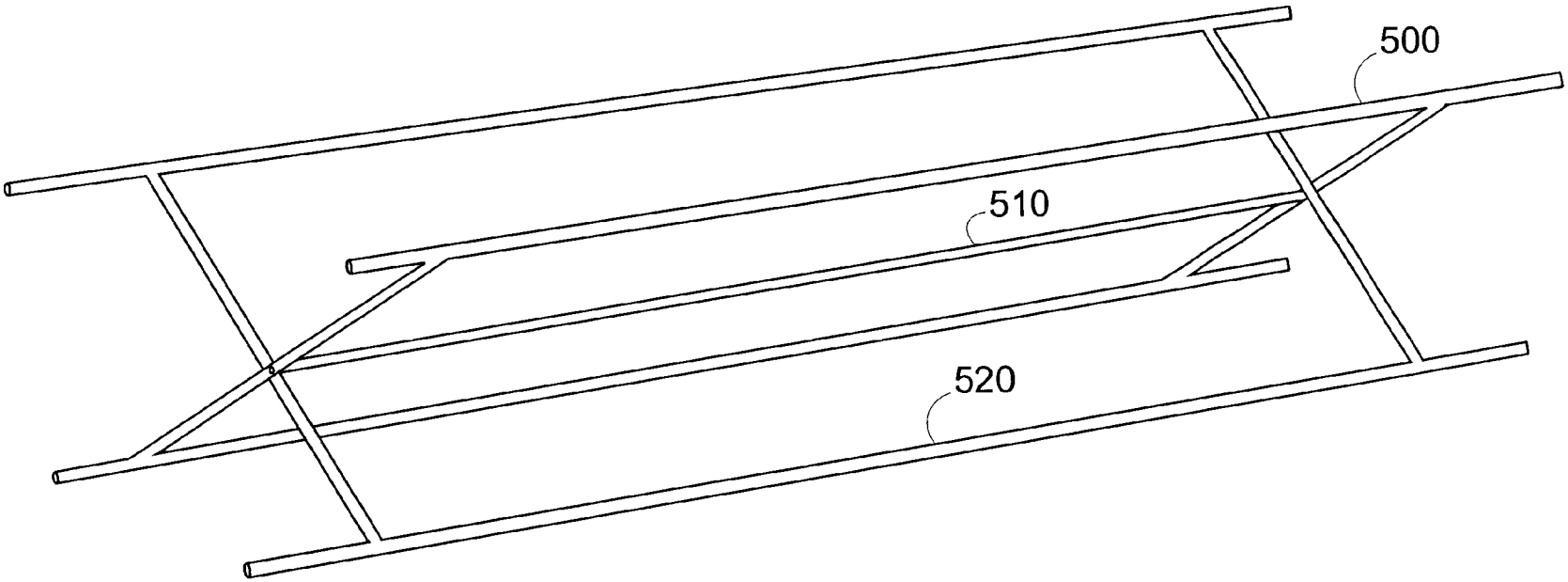
FIG. 5 is an elevational view of a base member according to the invention.

FIG. 5 shows an elevational view of one preferable embodiment of base member 160. In this embodiment, base member 160 is a scissor-type support which can fit into socket pairs in locking members 140. This embodiment also includes an optional centerbar 510 and optional bottom bars 520 for connecting the feet of base member 160. Each of the optional bars helps increase stability of base member 160.

Figure 6:
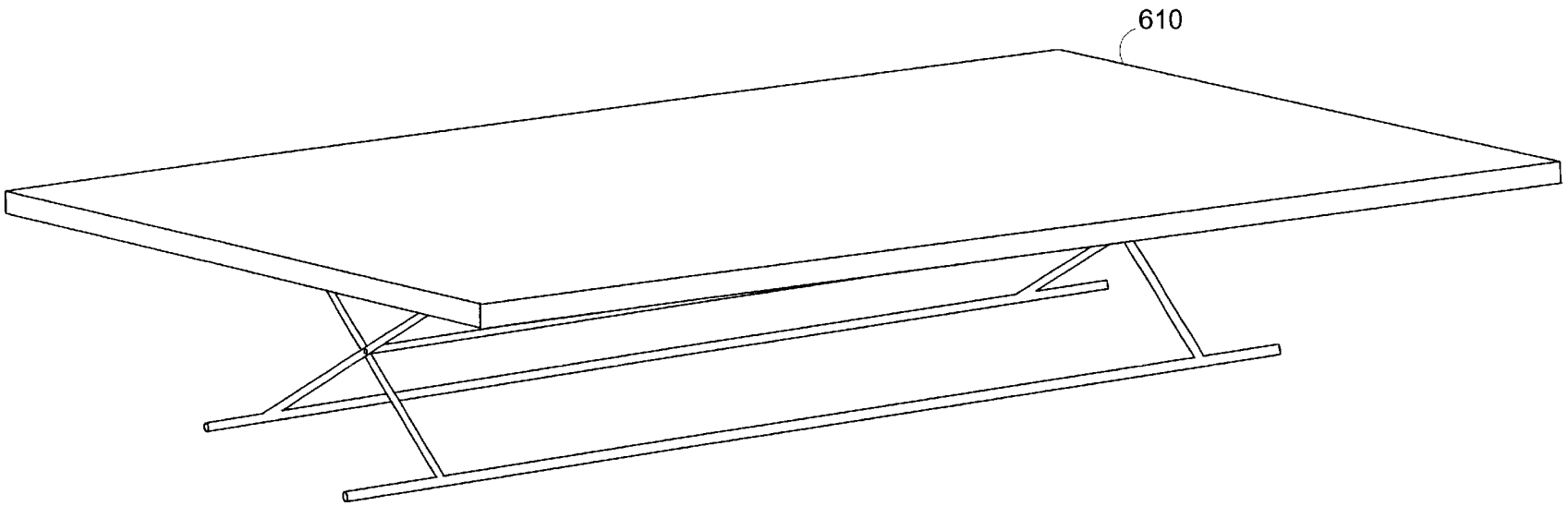
FIG. 6 is an elevational view of a convertible piece of furniture having a single surface member according to the invention.
Figure 6A:
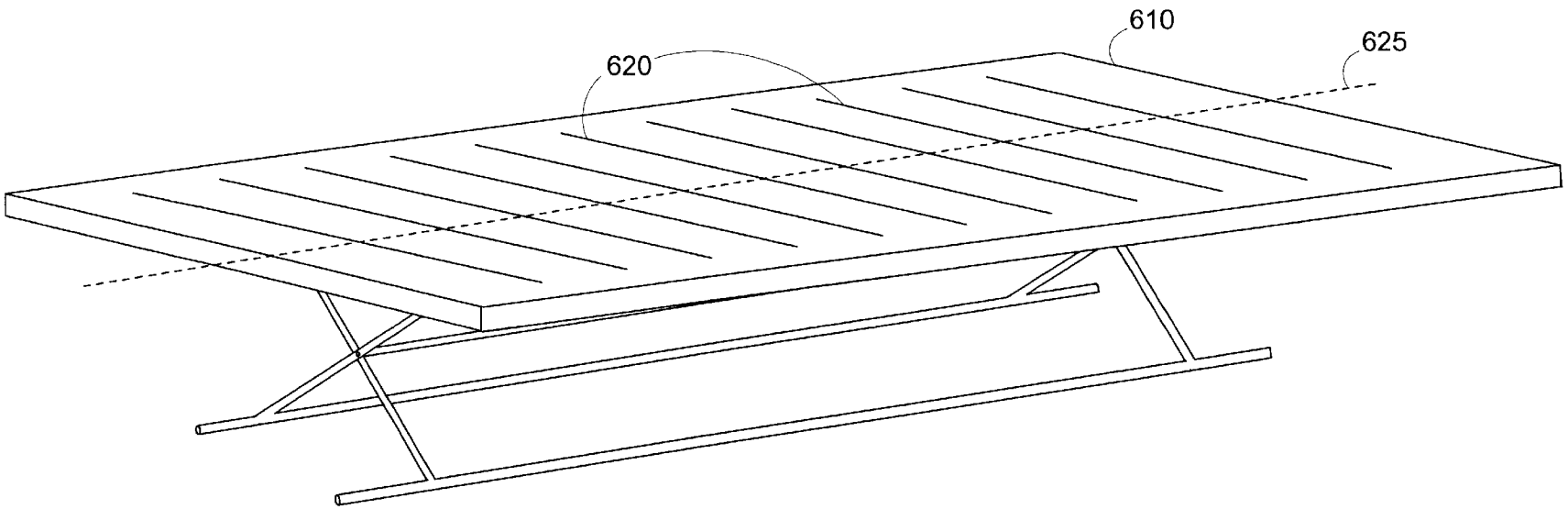
FIG. 6A is an elevational view of another convertible piece of furniture having a single surface member with perforations according to the invention.

FIG. 6 shows an alternate embodiment of a surface member 610. In this embodiment, surface member 610 includes a single piece of material. This material can be wood, plastic, cloth or other suitable flexible material. FIG. 6A shows another embodiment of surface member 610. In this embodiment, surface member 610 includes a single piece of material with perforations 620. Perforations 620 can be perpendicular to longitudinal axis 625 to provide surface member 610 with additional flexibility.

Figure 7B:
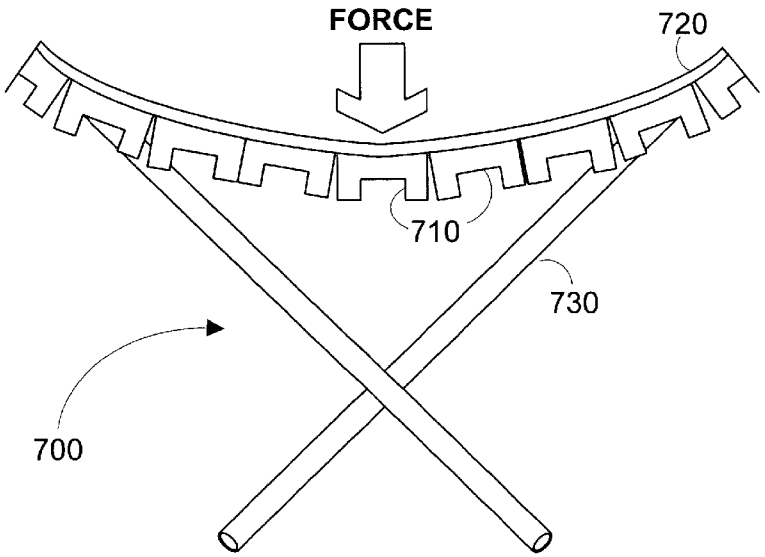
FIG. 7B is a front view of the convertible piece of furniture shown in FIG. 7A in a second position.
Figure 7A:
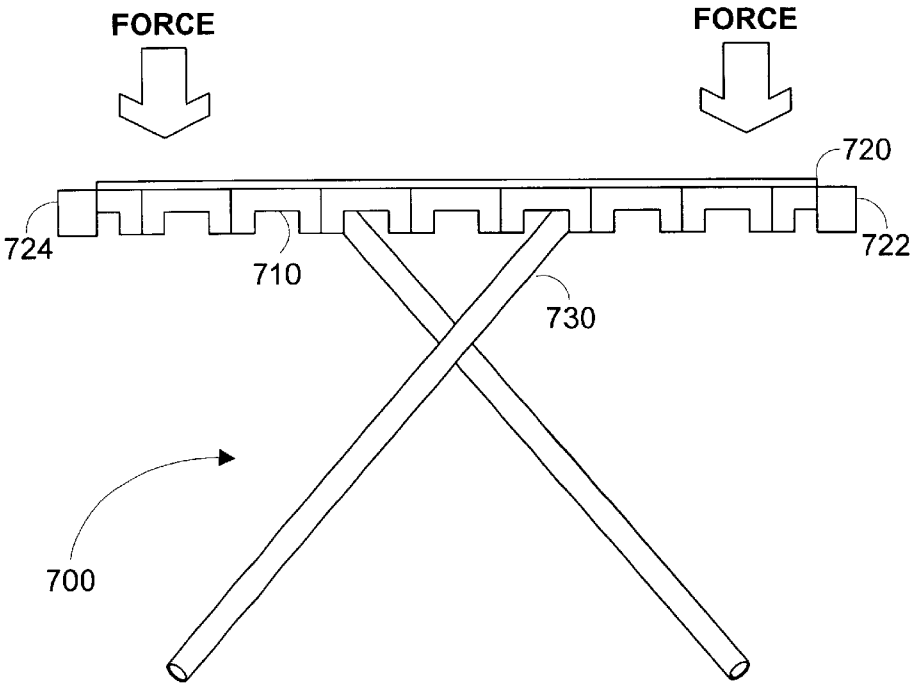
FIG. 7A is a front view of another embodiment of a convertible piece of furniture according to the invention in a first position.

FIGS. 7A and 7B show yet another alternative embodiment of the invention. In the article of furniture 700 shown in FIGS. 7A and 7B, channels 710, that preferably are attached to the underside of surface member 720, are used to engage base member 730. Channels 710 preferably run along a substantial portion of surface member 720.

FIGS. 7A and 7B show that channels 710 operate similarly to the locking slat 420 and blocks 430 shown in FIGS. 4A–D. In the position shown in FIG. 7A, when surface member 720 is supported proximal to its central longitudinal axis, channels 710 promote the rigidity of surface member 710 about the edges of surface member 720 because the walls of channels 710 tend to converge on one another and restrict flexibility of the surface when force is applied distant from the central longitudinal axis of surface member 720.

In the position shown in FIG. 7B, channels 710 allow surface member 720 to be flexible proximal to its central longitudinal axis because they do not converge on one another, but, rather, they tend to diverge as more force is applied proximal to the central longitudinal axis.

One advantage of the embodiment utilizing channels is that the elongated members are no longer required because the base member 730 is sufficient to support surface member 720 in both the first and second positions described above.

Channels 710 may be formed from aluminum or other suitable material. They may be bolted to surface member 720, glued on to surface member 720, or attached thereto in some other suitable manner. In one particular embodiment of the invention, a certain number of channels 710 may not be adapted for engaging base member 730 in order to limit the number of possible positions in which base member 730 engages channels 710.

Surface member 720 may be formed from slats, similar to the surface shown in FIGS. 1–5, or with a single piece of material, similar to the surface shown in FIG. 6.

If necessary, surface member 720 may be weighted at positions distal from its central longitudinal axis in order to promote rigidity of surface member 720 when article 700 is in a table position by forcing the channel walls together. For example, weights 722 and 724 may be coupled to or integrated with surface member 720 to promote rigidity when article 700 is in the table position. Integrated weighting may be accomplished by, for example, constructing outer portions (with respect to the central longitudinal axis) of surface member 720 with a heavier material than inner portions to promote table rigidity.

Figure 8:
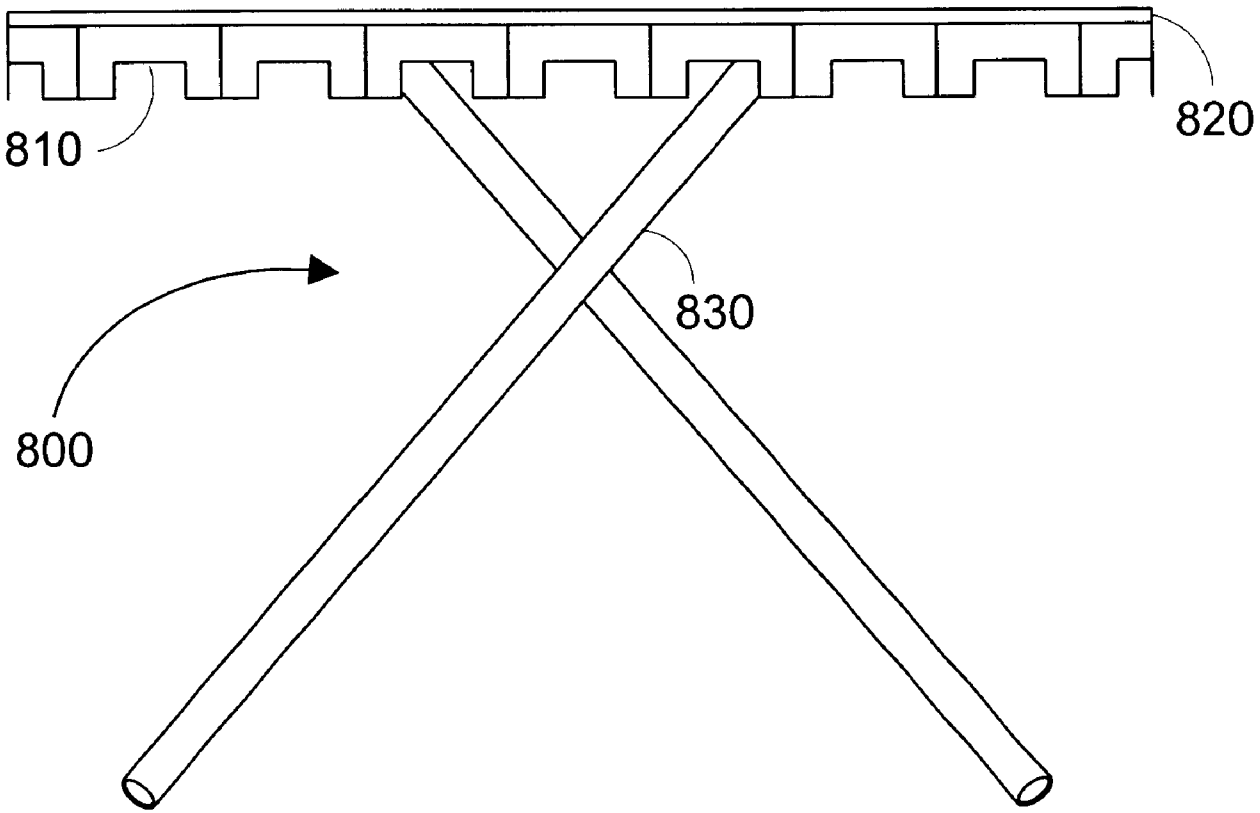
FIG. 8 is a front view of another embodiment of a convertible piece of furniture according to the invention.

FIG. 8 shows an alternative embodiment wherein channels 810 are molded into the underside of surface member 820 such that surface member 820 and channels 810 are formed from a single piece of material. This embodiment requires some hinged or otherwise flexible attachment between the portion of surface member 820 attached to one channel and the portion of surface member 820 attached to an adjacent channel.

Thus, a convertible piece of furniture which preferably provides a flat, flexible, relatively low surface in one position, and a flat, rigid, relatively high surface in a second position is provided. Persons skilled in the art will appreciate that the present invention can be practiced by other than the described embodiments, which are presented for purposes of illustration rather than of limitation, and the present invention is limited only by the claims which follow.

What is claimed is:

1. A convertible piece of furniture comprising:

a surface member having a central longitudinal axis and that provides a surface;

a base member movable between a first position and a second position whereby:

in a first position, said base member is fixedly engaged to said surface member distant from said axis such that said surface is relatively flexible; and in a second position, said base member is fixedly engaged to said surface member proximal to said axis and supports said surface member such that said surface member is relatively rigid.

2. The piece of furniture of claim 1 wherein said surface member includes a plurality of channels for engaging said base member.

3. The piece of furniture of claim 2 wherein said channels are substantially parallel to said axis.

4. The piece of furniture of claim 1 wherein said surface member comprises a plurality of flexible slats.

5. The piece of furniture of claim 4 wherein said slats are substantially perpendicular to said axis.

6. The piece of furniture of claim 1 wherein said surface member comprises a single piece of material.

7. The piece of furniture of claim 1 wherein said surface member comprises a single piece of material including a plurality of perforations that are substantially perpendicular to said axis.

8. The piece of furniture of claim 1 wherein said base member is a scissor-type support structure.

9. The piece of furniture of claim 1 wherein said surface is on one side of said surface member and said base member is engaged to a second side of said surface member.

10. The piece of furniture of claim 1 wherein said surface member comprises weights distal from said central longitudinal axis to promote rigidity of said surface member when said base member is in said second position.

11. A convertible piece of furniture comprising:

a first elongated member;

a second elongated member at a first distance from said first elongated member;

a surface member connected between said elongated members that provides a flexible surface therebetween, said surface member having a central longitudinal axis;

first and second locking members, each locking member having a first end, a second end and a midpoint, wherein the first locking member is connected to the first elongated member proximal to the first end of the first locking member and connected to the second locking member proximal to the second end of the first locking member, and the second locking member is connected to the first elongated member proximal to the first end of the second locking member and connected to the second locking member proximal to the second end of the second locking member;

a base member having first and second end portions and a support portion connected between the two end portions, the base member being connected to the locking members one of at least a first position and a second position whereby:

in the first position, said first end portion is connected proximal to said first and second ends of said first locking member and said second end portion is connected proximal to said first and second ends of said second locking member such that said surface is unsupported proximal to said axis by said support portion; and in a second position, said first end portion is connected proximal to the midpoint of said first locking member and said second end portion is connected proximal to the midpoint of said second locking member such that said surface is supported proximal to said axis by said support portion.

12. The piece of furniture of claim 11 wherein said first locking member includes a first plurality of sockets and said second locking member includes a second plurality of sockets corresponding to said first plurality of sockets, each of said first plurality of sockets forming a socket pair with a corresponding socket in said second plurality of sockets.

13. The piece of furniture of claim 12 wherein, in said first position, said base member is configured to be inserted in a first two socket pairs, said first pairs being distal from said axis, and, in said second position, said base member is configured to be inserted in a second two socket pairs, said second pairs being proximal to said axis.

14. The piece of furniture of claim 11 wherein said surface member comprises a plurality of flexible slats.

15. The piece of furniture of claim 14 wherein said slats are substantially perpendicular to said axis.

16. The piece of furniture of claim 11 wherein said surface member comprises a single piece of material having numerous perforations.

17. The piece of furniture of claim 16 wherein said perforations are substantially perpendicular to said axis.

18. The piece of furniture of claim 11 wherein said first and second elongated members are parallel to said axis.

19. The piece of furniture of claim 11 wherein said surface is a flat surface.

20. The piece of furniture of claim 11 wherein said base member is a scissor-type support structure.

21. The piece of furniture of claim 11 wherein said locking members comprise a slot which permits movement of said base member between said first position and said second position.

22. A convertible piece of furniture comprising:

a first elongated member;

a second elongated member at a first distance from said first elongated member;

a surface member connected between said elongated members and that provides a flexible surface therebetween, said surface member having a central longitudinal axis;

a first locking member connected between said elongated members;

a second locking member connected between said elongated members at a second distance from said first locking member; and a base member movable between a first position and a second position whereby:

in a first position said base member is fixedly engaged to each of said locking members distant from said axis such that said surface is relatively flexible; and in a second position said base member is fixedly engaged to each of said locking members proximal to said axis and supports said surface such that said surface is relatively rigid.

23. The piece of furniture of claim 22 wherein said first locking member includes a first plurality of sockets and said second locking member includes a second plurality of sockets corresponding to said first plurality of sockets, each of said first plurality of sockets forming a socket pair with a corresponding socket in said second plurality of sockets.

24. The piece of furniture of claim 23 wherein, in said first position, said base member is configured to be inserted in a first two socket pairs, said first pairs being distal from said axis, and, in said second position, said base member is configured to be inserted in a second two socket pairs, said second pairs being proximal to said axis.

25. The piece of furniture of claim 22 wherein said surface member comprises a plurality of flexible slats.

26. The piece of furniture of claim 25 wherein said slats are substantially perpendicular to said axis.

27. The piece of furniture of claim 22 wherein said surface member comprises a single piece of material having numerous perforations.

28. The piece of furniture of claim 27 wherein said perforations are substantially perpendicular to said axis.

29. The piece of furniture of claim 22 wherein said first and second elongated members are parallel to said axis.

30. The piece of furniture of claim 22 wherein said surface is a flat surface.

31. The piece of furniture of claim 22 wherein said base member is a scissor-type support structure.

32. The piece of furniture of claim 22 wherein said locking members comprise a slot which permits movement of said base member between said first position and said second position.

* * * * *